US005415706A

United States Patent [19]

Scarlin et al.

[11] Patent Number: 5,415,706

[45] Date of Patent: May 16, 1995

[54] HEAT- AND CREEP-RESISTANT STEEL HAVING A MARTENSITIC MICROSTRUCTURE PRODUCED BY A HEAT-TREATMENT PROCESS

[75] Inventors: Brendon Scarlin, Oberflachs; Markus Speidel, Birmenstorf; Peter Uggowitzer, Ottenbach, all of Switzerland

[73] Assignee: ABB Management AG, Baden, Switzerland

[21] Appl. No.: 239,413

[22] Filed: May 6, 1994

[30] Foreign Application Priority Data

May 28, 1993 [CH] Switzerland ..... 1060/93

[51] Int. Cl.[6] ..... C22C 38/44

[52] U.S. Cl. ..... 148/325

[58] Field of Search ..... 148/325; 420/38

[56] References Cited

U.S. PATENT DOCUMENTS 2,880,085 3/1959 Kirby et al. .

FOREIGN PATENT DOCUMENTS 0384433 8/1990 European Pat. Off. .
1541672 10/1968 France .
658115 10/1951 United Kingdom .
795471 5/1958 United Kingdom .
796733 6/1958 United Kingdom .

*Primary Examiner*—Deborah Yee
*Attorney, Agent, or Firm*—Burns, Doane, Swecker & Mathis

[57] ABSTRACT

The heat- and creep-resistant steel has a martensitic microstructure produced by a heat-treatment process. The composition of the steel in percent by weight is as follows:

0.001–0.05 of carbon
0.05–0.5 of silicon
0.05–2.0 of manganese
0.05–2.0 of nickel
8.0–13.0 of chromium
0.05–1.0 of molybdenum
1.00–4.0 of tungsten
0.05–0.5 of vanadium
0.01–0.2 of niobium
2.0–6.5 of cobalt
0.1–0.3 of nitrogen, the remainder being iron and unavoidable impurities. Such a steel can be produced by forging, casting or by powder-metallurgical means. Components fabricated from this steel show a high strength and ductility at room temperature and are distinguished at temperatures of 600° C. and higher by a very high creep strength and an unusually high oxidation resistance. They can therefore be used with advantage as mechanically and thermally highly stressed components in steam- and/or gas-operated power stations.

19 Claims, No Drawings

HEAT- AND CREEP-RESISTANT STEEL HAVING A MARTENSITIC MICROSTRUCTURE PRODUCED BY A HEAT-TREATMENT PROCESS

BACKGROUND OF THE INVENTION

1. Field of the Invention

The invention starts from a heat- and creep-resistant steel which has a martensitic microstructure produced by a heat-treatment process, which, in addition to iron and about 8–13% by weight of chromium, contains at least silicon, manganese, nickel, molybdenum, vanadium, niobium and tungsten. Such a steel can be produced by forging or casting or by powder-metallurgical means and, owing to its properties, it can be used with particular advantage for the manufacture of heat- and creep-resistant components of gas- and steam-operated power stations, such as in particular thermal turbomachines, for example gas turbines or steam turbines or compressors, or steam generators and other high-temperature installations and machines.

Especially in the development of steam turbines, an improvement of the efficiency by raising the temperature and pressure of the fresh steam is the main objective. Thus, a raising of the temperature and pressure from the nowadays usual values of about 550° C. and 240 bar to about 650° C. and 300 bar would improve the thermal efficiency of the steam turbines by about 10%. The associated reduction in fuel consumption not only lowers the production costs of electric power but at the same time considerably reduces the pollution of the environment. At the same time, steam turbines operating at high temperatures and pressures require a high flexibility in operation, such as, in particular, short starting times and a capability for peak load operation. For this purpose, however, a steel having a high strength and high ductility is required. This steel should show a predominantly ferritic and/or martensitic microstructure, since such a steel is substantially less expensive as compared with austenitic steel and, in addition, also has a higher thermal conductivity and a lower thermal expansion, which is particularly important for flexible operation of steam turbines.

2. Discussion of Background

The invention here refers to a state of the art such as results, for example, from DE 3,522,115 A. A martensitic steel known from this state of the art contains, in percent by weight, in addition to iron, 0.05–0.25 of carbon, 0.2–1.0 of silicon, up to 1 of manganese, 0.3–2.0 of nickel, 8.0–13 of chromium, 0.5–2.0 of molybdenum, 0.1 to 0.3 of vanadium, 0.03–0.3 of niobium, 0.01–0.2 of nitrogen and 1.1–2.0 of tungsten. This steel has, at room temperature, an elongation at break of at least 18% and is distinguished at a temperature of up to 600° C. by a high creep strength. At temperatures of 600° C. and higher, however, a high structural stability, a low tendency to embrittlement and especially also a high oxidation resistance are demanded from the steel used, in addition to a high creep strength.

SUMMARY OF THE INVENTION

Accordingly, one object of this invention, is to provide a novel heat- and creep-resistant steel which has a martensitic microstructure produced by a heat-treatment process and which is distinguished by properties which cause it to appear to be extremely promising in thermal turbomachines such as, in particular, steam turbines and gas turbines at temperatures of 600° C. and higher.

The steel according to the invention shows a thermally extremely stable and homogeneous microstructure. It is therefore distinguished, in contrast to comparable alloys of the state of the art, by a considerably improved creep strength and particularly good oxidation resistance. In addition, the steel according to the invention has an unusually high strength and toughness at room temperature. At the same time, it has an unexpectedly high yield point at elevated temperature between room temperature and the $A_{c1}$ temperature.

These advantageous properties, which are not to be expected, of the steel according to the invention are above all based on the fact that the carbon content is kept very low and the nitrogen content is kept comparatively high.

The effects of the individual elements of the steel according to the invention are as follows:

1. Carbon (C)

In conventional steels, carbon is the alloy element of decisive importance for the hardenability. During the annealing process, carbon forms the carbides such as, for example, $M_{23}C_6$, which are normally necessary for creep resistance. By contrast, carbon is replaced by nitrogen in the steel according to the invention. In place of carbides, thermally stable nitrides form in the steel according to the invention. In order to avoid precipitation of carbon-dominated phases, the carbon content should be low, at most 0.05 and preferably 0.001 to 0.03 percent by weight.

2. Silicon (Si)

Silicon promotes the formation of δ-ferrite and of a Laves phase. In addition silicon preferentially segregates at the grain boundary and reduces the toughness. The silicon content should therefore be less than 0.5 and preferably less than 0.2 percent by weight.

3. Manganese (Mn)

Manganese suppresses the formation of δ-ferrite and should therefore be kept at a value greater than 0.05 percent by weight. However, manganese also promotes the formation of a Laves phase and adversely affects the oxidation behavior. For this reason, the manganese content should not exceed 2 percent by weight. Preferably, the manganese content should be between 0.05 and 1 percent by weight.

4. Nickel (Ni)

Nickel suppresses the formation of δ-ferrite and should therefore be kept at a value above 0.05 percent by weight. High nickel contents lead to an inadmissible lowering of the $A_{cl}$ temperature, so that an annealing treatment at high temperatures will no longer be possible. For this reason, the nickel content should be between 0.05 and 2, and preferably between 0.3 and 1, percent by weight.

5. Chromium (Cr)

Chromium is the decisive alloying element for increasing the oxidation resistance, i.e. for the formation of a heat-resistant steel. To achieve a sufficient effect, the chromium content should be at least 8 percent by weight. An unduly high chromium content leads to the formation of δ-ferrite. The chromium content should thus be between 8 and 13, preferably between 8.5 and 11, percent by weight.

6. Molybdenum (Mo)

Molybdenum promotes the formation of stable nitrides of the $M_6X$ type and thus contributes to an increase in the creep strength. To ensure this, the molybdenum content should be greater than 0.05 percent by weight. However, high molybdenum contents promote the formation of δ-ferrite and the Laves phase. Accordingly, the molybdenum content should be between 0.05 and 1, preferably between 0.05 and 0.5, percent by weight.

7. Tungsten (W)

Tungsten substantially contributes to the formation of stable nitrides. In addition, tungsten assists the solid-solution hardening of the matrix. Furthermore, tungsten increases the solubility of nitrogen and thus permits economical manufacture of the steel according to the invention. Consequently, the tungsten content should be more than 1 percent by weight. Unduly high tungsten contents, however, promote the formation of δ-ferrite and the Laves phase. Accordingly, the tungsten content should be between 1 and 4, preferably between 1.5 and 3, percent by weight.

8. Vanadium (V)

In the steel according to the invention, vanadium is an element important for the formation of stable vanadium nitrides. To achieve an adequate hardening effect, the vanadium content must be greater than 0.05 percent by weight. At a high vanadium content, the tendency to form δ-ferrite increases. The vanadium content should thus expediently be in the range from 0.05 to 0.5, preferably 0.15 to 0.35, percent by weight.

9. Niobium (Nb)

Niobium bonds to nitrogen to give niobium nitride and thus assists the formation of a fine microstructure. A small part of niobium goes into solution during the hardening annealing and precipitates as niobium nitride during the tempering treatment. This phase improves the creep strength to a considerable extent. To ensure this, the niobium content should be more than 0.01 percent by weight. If, on the other hand, the niobium content is more than 0.2 percent by weight, niobium binds too much nitrogen, so that the precipitation of other nitrides is unduly suppressed. Accordingly, the niobium content should be between 0.01 and 0.2, preferably between 0.04 and 0.1, percent by weight.

10. Cobalt (Co)

Cobalt increases the creep strength of the steel according to the invention, since it favorably affects the formation of dislocation substructures and since it prevents or at least considerably retards the formation of δ-ferrite and the Laves phase. To obtain a favorable effect, the cobalt content should be more than 2 percent by weight. Too high cobalt contents unduly lower the $A_{c1}$ temperature and considerably increase the cost of the steel. Accordingly, the cobalt content should be between 2.0 and 6.5, preferably between 3.0 and 5.0, percent by weight.

11. Nitrogen (N)

With the elements V, Nb, Cr, W and Mo, nitrogen forms nitrides which, as a precipitation phase, are extremely stable thermally. Furthermore, nitrogen stabilizes austenite present in the steel according to the invention and thus prevents the formation of δ-ferrite. The favorable effect of nitrogen is assured by a nitrogen content of at least 0.1 percent by weight. Nitrogen contents of more than 0.3 percent by weight cannot be introduced into the steel in an inexpensive manner. The nitrogen content should therefore be between 0.1 and 0.3, preferably between 0.1 and 0.15, percent by weight.

DESCRIPTION OF THE PREFERRED EMBODIMENTS

A steel A according to the invention of about 10 kg in weight was smelted in a vacuum melting furnace under 1 bar of nitrogen, homogenized and forged to give bars After solution annealing at 1150° C., the steel was cooled in moving air and then tempered for about 4 hours at 780° C. Bars of corresponding dimensions were forged from commercially obtainable, tempered comparison steels B (steel according to the German Standard designation X20CrMoV 12 1) and C (steel according to the designation of a Japanese manufacturer). The chemical compositions of the steels A, B and C are shown in the table which follows.

| Steel | A (according to the invention) | B (X20CrMoV 12 1) | C (TR 1200) |
|---|---|---|---|
| Fe | | Base | |
| C | 0.018 | 0.23 | 0.14 |
| Si | 0.06 | 0.4 | 0.05 |
| Mn | 0.19 | 0.6 | 0.44 |
| Ni | 0.51 | 0.5 | 0.53 |
| Cr | 9.1 | 11.5 | 11.6 |
| Mo | 0.42 | 1.0 | 0.12 |
| W | 2.43 | 0.1 | 2.1 |
| V | 0.21 | 0.3 | 0.22 |
| Nb | 0.06 | 0.03 | 0.05 |
| Co | 4.2 | — | — |
| Cu | — | — | — |
| B | — | — | 0.001 |
| N | 0.12 | 0.05 | 0.055 |

The mechanical properties of these steels and the results of creep and oxidation tests can be taken from the table which follows. The creep strength was determined on prestressed specimens. The prestress still just absorbed by the specimens after 1000 hours at 600° C. was taken as a measure of the creep resistance. The oxidation resistance of the individual alloys was determined from the weight change of plate-shaped specimens which were exposed to air for 1000 hours at 650° C.

| Steel | A | B | C |
|---|---|---|---|
| $R_{p0.2}$ tensile yield strength [MPa] | 797 | 522 | 555 |
| Notched impact energy $A_v$ [J] [at room temperature] | 122 | 66 | 141 |
| Creep strength [Mpa] after 1000 hours at 600° C. | 260 | 160 | 190 |
| Oxidation resistance (weight change [mg/cm$^2$] at 650° C. for 1000 hours) | 0.002 | 0.02 | 0.016 |

A further increase in the creep strength of steel A and correspondingly of a steel of the composition:

0.001–0.05 of carbon
0.05–0.5 of silicon
0.05–2.0 of manganese
0.05–2.0 of nickel
8.0–13.0 of chromium
0.05–1.0 of molybdenum
1.00–4.0 of tungsten
0.05–0.5 of vanadium
0.01–0.2 of niobium
2.0–6.5 of cobalt
0.1–0.3 of nitrogen, the remainder being iron and unavoidable impurities, can be achieved with a content of about 0.001 to 0.03 percent by weight of boron. Boron would probably act here as a grain boundary hardener. In addition, boron nitrides would probably form after the addition of boron. Contents of less than 0.001 percent by weight of boron do not effect any significant increase in the creep strength, whereas a boron content of more than 0.03 percent by weight adversely affects the toughness and weldability of the steel. Particularly good creep strength values are obtained with boron contents of 0.006 to 0.015 percent by weight.

A content of 0.001 to 2 percent by weight of copper also favorably affects the steel according to the invention, since copper suppresses the formation of δ-ferrite without substantially lowering the $A_{c1}$ temperature. Moreover, copper improves the mechanical properties in the heat-affected zone of weld seams. At copper contents of more than 2 percent by weight, however, elemental copper is precipitated on the grain boundaries. Therefore, the copper content should not exceed 2 percent by weight.

The steel according to the invention shows a substantially δ-ferrite-free microstructure consisting of a martensite tempered in a heat-treatment process. This microstructure and the properties caused thereby, such as creep strength and oxidation resistance at temperatures of 600° C. and also strength and toughness at room temperature, are assured with certainty whenever the elements present therein, namely chromium (Cr), molybdenum (Mo), tungsten (W), vanadium (V), niobium (Nb), silicon (Si), nickel (Ni), cobalt (Co), manganese (Mn), nitrogen (N), carbon (C) and copper (Cu) if present, meet the inequality given below (element content in percent by weight):

$$(Cr+1.5\ Mo+1.5\ W+2.3\ V+1.75\ Nb+0.48\ Si-Ni-Co-0.3\ Cu-0.1\ Mn-18N-30\ C)<10$$

It is therefore advisable, if appropriate, to restrict the constituents of the steel according to the invention accordingly.

A change in the microstructure associated with a reduced creep resistance and an embrittlement due to formation of the Laves phase can be avoided in the steel according to the invention, if the elements present therein, namely iron (Fe), chromium (Cr), molybdenum (Mo), tungsten (W), cobalt (Co), nickel (Ni), vanadium (V) and copper (Cu) if present, meet the inequality given below (element content in atom percent):

$$(0.858\ Fe+1.142\ Cr+1.55\ Mo+1.655\ W+0.777\ Co+0.717\ Ni+0.615\ Cu+1.543\ V)<89.5$$

or, in a particularly advantageous manner, meet the inequality:

$$(0.858\ Fe+1.142\ Cr+1.55\ Mo+1.655\ W+0.777\ Co+0.717\ Ni+0.615\ Cu+1.543\ V)<89.0.$$

Obviously, numerous modifications and variations of the present invention are possible in the light of the above teachings. It is therefore to be understood that, within the scope of the appended claims, the invention may be practised otherwise than as specifically described herein.

What is claimed is:

1. A heat- and creep-resistant steel having a martensitic microstructure produced by a heat-treatment process, which has the following composition in percent by weight:

0.001–0.05 of carbon
0.05–0.5 of silicon
0.05–2.0 of manganese
0.05–2.0 of nickel
8.0–13.0 of chromium
0.05–1.0 of molybdenum
1.00–4.0 of tungsten
0.05–0.5 of vanadium
0.01–0.2 of niobium
2.0–6.5 of cobalt
0.1–0.3 of nitrogen, the remainder being iron and unavoidable impurities.

2. A steel as claimed in claim 1, which has the following composition in percent by weight:

0.001–0.03 of carbon
0.05–0.5 of silicon
0.05–2.0 of manganese
0.05–2.0 of nickel
8.0–13.0 of chromium
0.05–1.0 of molybdenum
1.00–4.0 of tungsten
0.05–0.5 of vanadium
0.01–0.2 of niobium
2.0–6.5 of cobalt
0.1–0.15 of nitrogen the remainder being iron and unavoidable impurities.

3. A steel as claimed in claim 2, which has the following composition in percent by weight:

0.001–0.03 of carbon
0.05–0.2 of silicon
0.05–1.0 of manganese
0.3–1.0 of nickel
8.5–11.0 of chromium
0.05–0.5 of molybdenum
1.5–3.0 of tungsten
0.15–0.35 of vanadium
0.04–0.1 of niobium
3.0–5.0 of cobalt
0.1–0.15 of nitrogen the remainder being iron and unavoidable impurities.

4. A steel as claimed in claim 1, which additionally has a content of 0.001–2 percent by weight of copper.

5. A steel as claimed in claim 1, which additionally has a content of 0.001–0.03 percent by weight of boron.

6. A steel as claimed in claim 5, which contains 0.006–0.015 percent by weight of boron.

7. A steel as claimed in claim 1, wherein the elements present therein, namely iron (Fe), chromium (Cr), molybdenum (Mo), tungsten (W), cobalt (Co), Nickel (Ni), vanadium (V) and copper (Cu) if present meet the inequality given below (element content in atom percent):

$$(0.858\ Fe+1.142\ Cr+1.55\ Mo+1.655\ W+0.777\ Co+0.717\ Ni+0.615\ Cu+1.543\ V)<89.5.$$

8. A steel as claimed in claim 3, wherein the elements present therein, namely iron (Fe), chromium (Cr), molybdenum (Mo), tungsten (W), cobalt (Co), nickel (Ni), vanadium (V) and copper (Cu) if present, meet the inequality given below (element content in atom percent):

$$(0.858\ Fe+1.142\ Cr+1.55\ Mo+1.655\ W+0.777\ Co+0.717\ Ni+0.615\ Cu+1.543\ V)<89.0.$$

9. A steel as claimed in claim 1, wherein the elements present therein, namely chromium (Cr), molybdenum (Mo), tungsten (W), vanadium (V), niobium (Nb), silicon (Si), nickel (Ni), cobalt (Co), manganese (Mn), nitrogen (N), carbon (C) and copper (Cu) if present, meet the inequality given below (element content in percent by weight):

$$(Cr+1.5\ Mo+1.5\ W+2.3\ V+1.75\ Nb+0.48\ Si-Ni-Co-0.3\ Cu-0.1\ Mn-18\ N-30\ C)<10.$$

10. A steel as claimed in claim 1, in a solution annealed, air cooled and tempered condition.

11. A steel as claimed in claim 1, wherein the carbon content is 0.001 to 0.03%.

12. A steel as claimed in claim 1, wherein the silicon content is less than 0.2%.

13. A steel as claimed in claim 1, wherein the manganese content is 0.05 to 1.0%.

14. A steel as claimed in claim 1, wherein the chromium content is 8.5 to 11.0%.

15. A steel as claimed in claim 1, wherein the molybdenum content is 0.05 to 0.5%.

16. A steel as claimed in claim 1, wherein the tungsten content is 1.5 to 3.0%.

17. A steel as claimed in claim 1, wherein the vanadium content is 0.15 to 0.35%.

18. A steel as claimed in claim 1, wherein the niobium content is 0.04 to 0.1%.

19. A steel as claimed in claim 1, wherein the nickel content is 0.3 to 1.0%.

* * * * *